US005860578A

United States Patent [19]

Laguna

[11] Patent Number: 5,860,578

[45] Date of Patent: Jan. 19, 1999

[54] PAPER DISPENSER

[75] Inventor: José Luis Cobos Laguna, Alicante, Spain

[73] Assignee: Jofel Industrial, S.A., Alicante, Spain

[21] Appl. No.: 866,382

[22] Filed: May 30, 1997

Related U.S. Application Data

[63] Continuation of Ser. No. 489,811, Jun. 13, 1995, abandoned.

[30] Foreign Application Priority Data

Sep. 21, 1994 [ES] Spain ..... 9402408

[51] Int. Cl.[6] ..... B26F 3/02

[52] U.S. Cl. ..... 225/10; 225/16; 225/39; 225/77

[58] Field of Search ..... 225/9, 10, 16, 225/21, 22, 25, 23, 39, 42, 43, 67, 88, 91, 11, 46, 47, 6; 242/564.2, 564.4

[56] References Cited

U.S. PATENT DOCUMENTS

| | | | |
|---|---|---|---|
| Re. 20,333 | 4/1937 | Perrin | 225/23 X |
| 1,949,373 | 2/1934 | Hill | 225/23 |
| 2,138,154 | 11/1938 | Grunwald | 225/23 X |
| 2,139,339 | 12/1938 | Vaughan et al. | 225/16 X |
| 2,174,190 | 9/1939 | Hunt | 225/39 X |
| 2,202,011 | 5/1940 | Krueger et al. | 225/16 X |
| 2,206,951 | 7/1940 | Grunwald | 225/10 X |
| 2,206,978 | 7/1940 | Steiner | 225/16 X |
| 2,219,570 | 10/1940 | Vaughan et al. | 225/16 |
| 2,303,520 | 12/1942 | Wilson | 225/43 X |
| 2,487,061 | 11/1949 | Ptasnik | 225/23 X |
| 2,536,066 | 1/1951 | Krueger | 225/23 X |
| 2,642,939 | 6/1953 | Oldenburg et al. | 225/9 |
| 2,671,271 | 3/1954 | Aldrich | 225/21 X |
| 2,732,271 | 1/1956 | Hanson | 225/10 X |
| 2,839,345 | 6/1958 | Engel et al. | 225/23 X |
| 2,850,345 | 9/1958 | Marcuse et al. | 225/23 |
| 2,957,738 | 10/1960 | Marcuse | 225/39 X |
| 3,667,825 | 6/1972 | Pagel | 225/23 X |
| 3,707,251 | 12/1972 | Dashnier et al. | 225/21 X |
| 3,713,569 | 1/1973 | Dashnier et al. | 225/21 X |
| 3,730,409 | 5/1973 | Ratti | 225/10 X |
| 3,737,087 | 6/1973 | Rooklyn | 225/23 X |
| 4,775,084 | 10/1988 | Morikami et al. | 225/16 X |
| 4,790,490 | 12/1988 | Chakravorty | 225/16 X |
| 4,846,412 | 7/1989 | Morand | 225/91 X |
| 4,944,441 | 7/1990 | Gana | 225/16 X |
| 5,048,386 | 9/1991 | DeLuca et al. | 225/106 X |
| 5,125,548 | 6/1992 | Perrin et al. | 225/16 X |
| 5,452,832 | 9/1995 | Niada | 225/10 X |

FOREIGN PATENT DOCUMENTS

| | | | |
|---|---|---|---|
| 130604 | 12/1948 | Australia | 225/23 |
| 593273 | 2/1960 | Canada | 225/16 |
| 661505 | 4/1963 | Canada | 225/39 |
| 2234772 | 1/1975 | France | 225/16 |
| 693130 | 5/1957 | Germany | 225/16 |
| 465165 | 8/1951 | Italy | 225/16 |
| 39493 | 6/1936 | Netherlands | 225/16 |
| 8702294 | 4/1987 | WIPO | 83/649 |

*Primary Examiner*—Rinaldi I. Rada
*Assistant Examiner*—Boyer Ashley
*Attorney, Agent, or Firm*—Ostrolenk, Faber, Gerb & Soffen, LLP

[57] ABSTRACT

A paper dispenser with a rear part fastenable to a wall on which a paper roll is supported and with a front part articulated closed over the rear part. A roller around which the dispensing paper is wrapped such that rotation of that roller moves the paper off the paper roll. A base part supported on the front part of the dispenser at the roller defines a slot with the roller through which the paper passes. A knife supported on the base part cuts the paper as it is pulled out of the dispenser. A pinion on the roller is rotated by a rack that is supported on the frame and that is movable by a lever projecting out of the front part, such that movement of the lever moves the rack to move the pinion to move the roller to move paper off the roll and dispense it.

19 Claims, 2 Drawing Sheets

PAPER DISPENSER

This is a continuation of application Ser. No. 08/489,811 filed on Jun. 13, 1995 now abandoned.

BACKGROUND OF THE INVENTION

The present invention relates to a dispenser for paper which is used primarily for drying or cleaning one's hands and particularly to the drive for dispensing the paper.

SUMMARY OF THE INVENTION

The dispenser is of the type which is fastened to a wall. Inside the dispenser, there is a roll of paper that may be dispensed to enable the user to use it to the extent necessary to dry or clean his hands.

Compared with other known dispensers, the dispenser of the invention is structurally simple, including its frame, and permits easy and reliable placement of the roll of paper in the housing. An actuating device dispenses an amount of paper for immediate use. The dispenser is simple to use.

The dispenser according to the invention includes a substantially block shaped frame. The frame is comprised of front and rear main parts which are connected together, e.g. in rotation. The rear part is fastened to a wall. The other-front part serves as the cover of and as the front face of the dispenser. The rear part which is fastened to the wall has the form of a receptacle with an open front. On its rear wall, a support is mounted for a roll of paper, and the roll is suspended from the support.

The free end of the paper roll is passed so that the paper is wrapped partially around a roller.

A smooth surface follows after the roller in the paper path and faces toward and is close to the roller. It includes means for adjusting the distance of that surface from the roller.

The roller is rotatably mounted in supports in the frame. A toothed or gear ring or pinion is fastened on one of the roller ends. The ring meshes with toothing, on a toothed rack, which is provided on a part which is turnable around a pin supported on the frame. The roller is actuated manually by means of a lever which extends through a slot in the front frame part defining the cover. When the lever is pressed by hand, it moves an inner part and a rack inside the dispenser. The rack meshes with the pinion on the roller. Movement of the lever and of the rack causes the toothed pinion of the roller to turn, and this carries along a portion of paper equivalent to the rotation or number of turns given by the roller.

The rotary rack bearing its toothing can be positioned by means of a spring to be biased into its state of rest.

Other features and advantages of the present invention will become apparent from the following description of the invention which refers to the accompanying drawings.

DETAILED DESCRIPTION OF AN EMBODIMENT OF THE INVENTION

Figure 1:
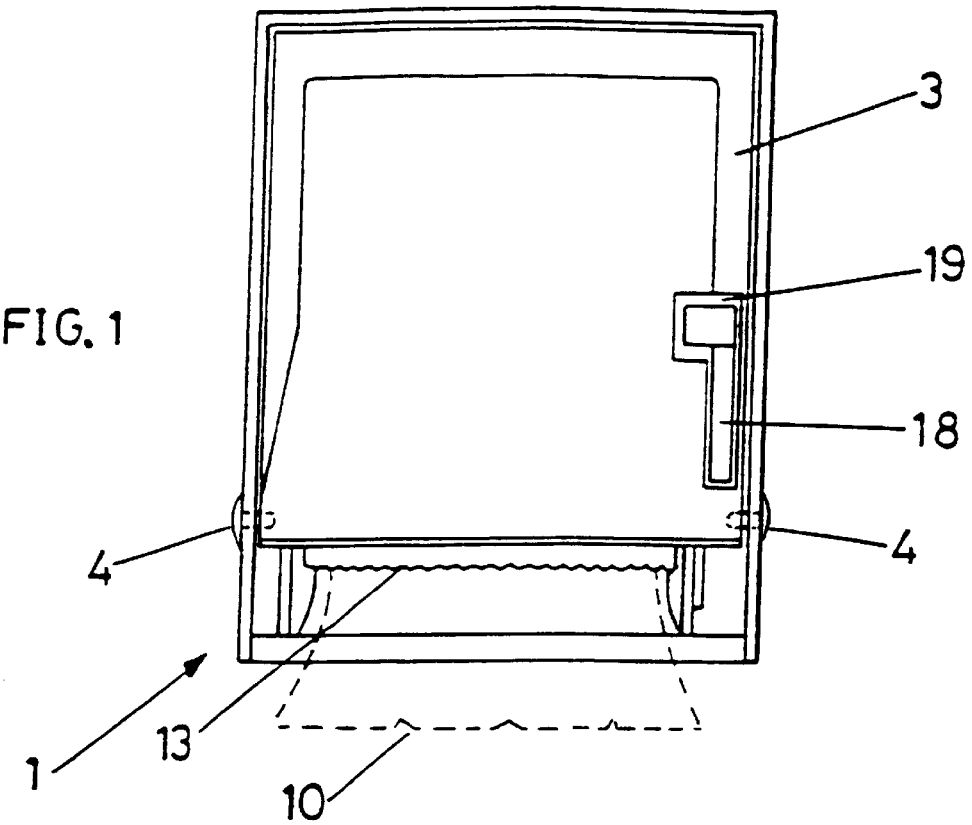
FIG. 1 is a front view of a paper dispenser of the invention.
Figure 2:
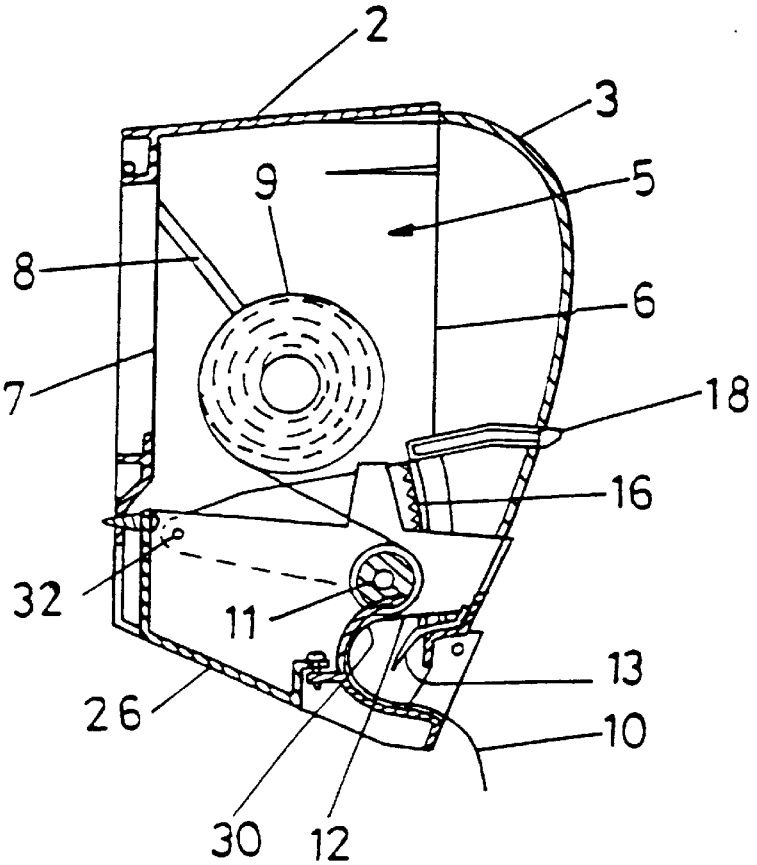
FIG. 2 is a sectional view through the dispenser.
Figure 3:
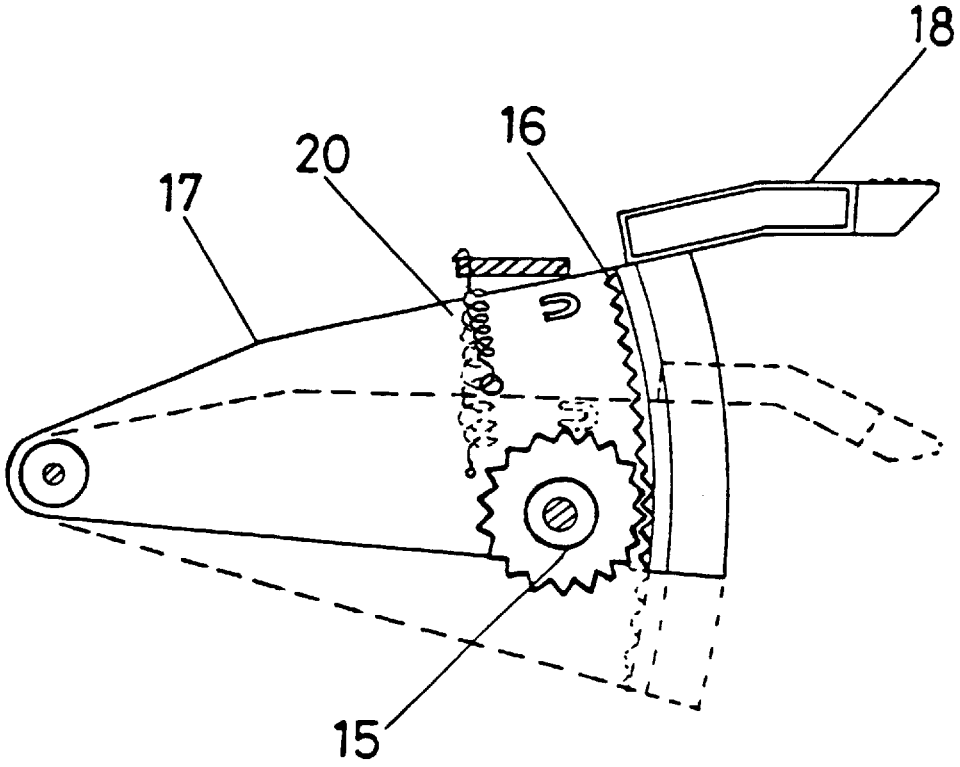
FIG. 3 is a side view of the actuating mechanism for the paper dispenser.

The dispenser 1 of the invention comprises rear and front parts 2 and 3, respectively, which are swingable with respect to each other around end pins 4.

The rear part 2 is fastened to a wall and defines a receptacle 5 which is open on its front face 6. The rear inside face 7 of the rear part supports a U-shaped support 8 for a roll of paper 9 so that the roll is suspended. The free end 10 of paper is passed between the roller 11 and a base part 12, to which a cutting knife 13 is fastened by means of screws. The base part applies tension to the paper as it pases between the roller and the base part 12.

Past the roller is a smooth surface 30, curved toward the roller, its shape and position determining the angle of wrap of paper on the roller.

The roller 11 is rotatable. It is mounted on a support tray 26 which is in turn screwed to the rear wall or rear part 2. The roller has mounted on one of its ends a toothed pinion 15 which meshes at all times with a toothed rack 16. The rack is part of a rotary part 17 that is pivotally secured at the rear of support tray 26 by pivot 32. The rotary part is provided with a lever 18 which extends out through a slot 19 provided in the front part 3. The rotary part 17 acts against the elastic action of a spring 20 which, at rest, holds the part 17 in position.

The dispenser is preferably made of plastic.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A paper dispenser for dispensing paper, comprising:

a frame having a rear part for mounting the paper dispenser, the rear part having a front side;

a front part attached to the rear part and enclosing a space within the dispenser;

a support on the front side of the rear part for supporting a roll of paper to be dispensed;

a roller supported in the dispenser and spaced from the roll of paper, the paper passing over the roller when the paper is unwound from the roll;

a base part having two extremities, one being a front end and the other being a rear end, said front end being closer to the front part of the dispenser than the rear end and said rear end being closer to the rear part of the dispenser than the front end, the base part having a substantially flat portion extending from the front end of the base part toward the rear end of the base part, the base part being supported in the dispenser and toward the roller, such that the flat portion of the base part extends in a direction that is horizontally from the front part of the dispenser to the rear part of the dispenser, wherein the rear end of the base part is closer to the roller than the front end such that the paper is passed between a lower portion of the roller and a curved surface at the rear end of the base part, the flat portion of the base part being disposed substantially tangentially with respect to the roller, the base part causing the paper to wrap partly around the roller;

a pinion on and rotatable with the roller;

a rack supported on the frame, in engagement with the pinion and movable with reference to the pinion for rotating the pinion and therefore, the roller; and a lever attached to the rack for being engaged such that upon movement of the lever and the attached rack, the pinion and the roller are rotated urging the paper to move around the roller and out of the dispenser.

2. The paper dispenser of claim 1, wherein the base part is supported by the front part of the dispenser.

3. The paper dispenser of claim 1, wherein the flat portion of the base part presses the paper against the roller.

4. The paper dispenser of claim 1, wherein the roller is made of plastic.

5. The paper dispenser of claim 1, further comprising a separate knife element attached to the base part.

6. The paper dispenser of claim 1, wherein the base part is positioned in the dispenser to cooperate with the roller for defining a slot through which the paper is passed and for defining a pathway of the paper around the roller, whereby rotation of the roller moves the paper off the paper roll and on a path out of the dispenser.

7. The paper dispenser of claim 6, further comprising a knife supported on the base part and projecting therefrom such that pulling the paper out of the dispenser presses the paper against the knife for causing the knife to cut the paper.

8. The paper dispenser of claim 6, wherein the pinion and the rack are cooperatingly correspondingly toothed.

9. The paper dispenser of claim 8, wherein the front part of the frame has an opening therethrough, through which the lever to the rack extends for being engaged;

the front part of the frame includes a slot through which the paper that has passed the roller is moved to exit from the dispenser.

10. The paper dispenser of claim 1, wherein the surface of the base part is disposed within the dispenser adjacent the roller for contacting the paper which has passed over the roller.

11. The paper dispenser of claim 10, wherein a position of the base part with respect to the roller determines an angle over which the paper passes the roller.

12. A paper dispenser for dispensing paper, comprising:

a frame having a rear part for mounting the paper dispenser, the rear part having a front sided;

a front part attached to the rear part and enclosing a space within the dispenser;

a support on the front side of the rear part for supporting a roll of paper to be dispensed; and a tray disposed in a bottom of the frame, the tray supporting:

a roller spaced from the roll of paper, the paper passing over the roller when the paper is unwound from the roll;

a base part having two extremities, one being a front end and the other being a rear end, said front end being closer to the front part of the dispenser than the rear end and said rear end being closer to the rear part of the dispenser than the front end, the base part having a substantially flat portion extending from the front end of the base part toward the rear end of the base part and supported toward the roller, such that the flat portion of the base part extends in a direction that is horizontally from the front part of the dispenser to the rear part of the dispenser, wherein the rear end of the base part is closer to the roller than the front end such that the paper is passed between a lower portion of the roller and a curved surface at the rear end of the base part, the flat portion of the base part being disposed substantially tangentially with respect to the roller, the base part causing the paper to wrap partly around the roller;

a pinion on and rotatable with the roller;

a rack supported in engagement with the pinion and movable with reference to the pinion for rotating the pinion and therefore, the roller; and a lever attached to the rack for being engaged such that upon movement of the lever and the attached rack, the pinion and the roller are rotated urging the paper to move around the roller and out of the dispenser.

13. The paper dispenser of claim 12, a position of the base part with respect to the roller determines an angle over which the paper passes the roller.

14. The paper dispenser of claim 12, wherein the base part is supported by a front part of the tray.

15. The paper dispenser of claim 12, wherein the base part presses the paper against the roller.

16. The paper dispenser of claim 12, further comprising a knife supported on the base part and projecting therefrom such that pulling the paper out of the dispenser presses the paper against the knife for causing the knife to cut the paper.

17. The paper dispenser of claim 12, wherein the roller is made of plastic.

18. The paper dispenser of claim 12, further comprising a separate knife element attached to the base part.

19. A paper dispenser for dispensing paper, comprising:

a frame having a rear part for mounting the paper dispenser, the rear part having a front side;

a front part attached to the rear part and enclosing a space within the dispenser;

a support on the front side of the rear part for supporting a roll of paper to be dispensed;

a roller supported in the dispenser and spaced from the roll of paper, the paper passing over the roller when the paper is unwound form the roll;

a base part having two extremities, one being a front end and the other being a rear end, said front end being closer to the front part of the dispenser than the rear end and said rear end being closer to the rear part of the dispenser than the front end, the base part having a substantially flat portion extending from the front end of the base part toward the rear end of the base part and supported toward the roller, such that the flat portion of the base part extends in a direction that is horizontally from the front part of the dispenser to the rear part of the dispenser, wherein the rear end of the base part is closer to the roller than the front end such that the paper is passed between a lower portion of the roller and a curved surface at the rear end of the base part, the flat portion of base part being disposed substantially tangentially with respect to the roller, the base part causing the paper to wrap partly around the roller;

a knife mounted on the base part and projecting thereform such that pulling the paper out of the dispenser presses the paper against the knife for causing the knife to cut the paper;

a pinion on and rotatable with the roller;

a rack supported on the frame, in engagement with the pinion and movable with reference to the pinion for rotating the pinion and therefore the roller;

a lever attached to the rack for being engaged such that upon movement of the lever and the attached rack, the pinion and the roller are rotated urging the paper to move around the roller and out of the dispenser.

* * * * *